US005179813A

United States Patent [19]

Martinsen et al.

[11] Patent Number: 5,179,813

[45] Date of Patent: Jan. 19, 1993

[54] REPAIRING SQUEAKING FLOORS

[76] Inventors: Lyle J. Martinsen, 315 E. 6310 S.; Stewart L. Martinsen, 631 Mount Vernon Cir., both of Murray, Utah 84107; Lane G. Martinsen, 7443 S. Rich Way, Salt Lake City, Utah 84121

[21] Appl. No.: 691,190

[22] Filed: Apr. 25, 1991

[51] Int. Cl.[5] ..... E04B 1/00

[52] U.S. Cl. ..... 52/743; 52/514

[58] Field of Search ..... 52/514, 173 R, 743, 52/744, 309.5; 405/269

[56] References Cited

U.S. PATENT DOCUMENTS 3,900,541 8/1975 Klapwijk ..... 52/744 X 4,644,720 2/1987 Schneidel ..... 52/743 X

*Primary Examiner*—David A. Scherbel

*Assistant Examiner*—Creighton Smith

*Attorney, Agent, or Firm*—Lynn G. Foster

[57] ABSTRACT

Novel methods and apparatus are disclosed by which squeaking floors are facilely, reliably and economically repaired by internal injection of glue or the like without the disassembly of floor components or substantial removal of a floor covering.

18 Claims, 3 Drawing Sheets

REPAIRING SQUEAKING FLOORS

FIELD OF INVENTION

The present invention relates generally to the repair of floors in homes and other buildings and, more particularly, to novel methods and apparatus by which squeaking floors in a residence, commercial building or the like are reliably, facilely and economically repaired.

THE PROBLEM

It is a common experience to walk across a floor of a residential, commercial or other building and hear a wood-based floor squeak in response to placement and removal of weight of the person crossing the floor. Floor squeaking may be caused by a number of variables, but movement at joints between floor components, and movement between parts of the flooring in relation to subflooring are chief causes of the problem. Loosening of floor nails and/or other floor fasteners, such as staples, contributes to the problem.

The aforementioned squeaking floor problem has defied reliable, facile and economical solution for many years, indeed decades.

Nails driven through a floor covering, the floor and into, if not through, the subfloor usually help somewhat, but do not cure the problem. Typically, the residual exposed portions of such nails are unsightly.

One approach which normally works, but involves reconstruction as opposed to repair and is normally cost prohibitive, is that of taking up the floor covering and the elevated part of the floor, leaving the subfloor exposed. Thereafter, on a labor intensive basis, the old floor or a new floor is superimposed upon the exposed subfloor using glue and screw fasteners. New floor covering is then placed over the floor. Even when the reconstruction is completed, some squeaking due to relative floor movement may still occur. The inconvenience often rules out this reconstruction approach, even where financial considerations are not prohibitive.

Because of cost, inconvenience, and uncertainty of repair, many, if not most, floor squeaks are left unattended. This creates an ongoing annoyance, often one of significant magnitude due to interruption in sleep, embarrassment when guests and visitors are present and the loss of a sale to a prospective buyer of the building.

From the foregoing, it is clear that there has long existed an unsatisfied need for a reliable, facile and economical way to repair squeaking floors.

BRIEF SUMMARY AND OBJECTS OF THE INVENTION

In brief summary, the present invention overcomes or substantially alleviates the problem mentioned above and comprises novel methods and apparatus by which squeaky floors are reliably, facilely and economically de-squeaked without disassembly of floor components or significant removal of a floor covering (where a floor covering is involved).

With the foregoing in mind, it is a primary object to overcome or substantially alleviate the above-mentioned problem of the related art.

Another object of significance is the provision of novel methods and apparatus by which a squeaky floor can be de-squeaked.

A further important object is the provision of methods and apparatus by which squeaking floors can be novelly repaired in a reliable, facile and economical fashion.

Still another paramount object is the provision of methodology, materials, and equipment by which a floor can be novelly de-squeaked without disassembly of components comprising the floor or significant removal of a floor covering.

These and other objects and features of the present invention will be apparent from the detailed description taken with reference to the accompanying drawings.

DETAILED DESCRIPTION OF THE ILLUSTRATED EMBODIMENTS

Reference is now made in detail to the drawings wherein like numerals are used to designate like parts throughout. Essence of the present invention is to eliminate a squeak in a floor by internally injecting glue or other suitable flowable and curable filler material or substance into the floor in such a way that when the glue or other filler material solidifies. An essentially monolithic floor results where components, in the area of the injection, are no longer free to move one in respect to another.

It has been found that the injection of glue or the like at an interface internal within the floor immediately above the top surface of the subfloor causes the glue to infiltrate the interface as well as contiguous seams, joints, and nail holes. Also, the fibers of the wood located adjacent to the interface are infiltrated and impregnated. Nails and other fasteners are encapsulated at the injection site in such a way that, upon curing of the glue, the floor at the injection site no longer comprises components which may move one in respect to another to cause squeaking. The present invention also contemplates injection of glue or the like between the bottom of a subfloor and the top of a floor joist, to prevent relative movement and thereby prevent further squeaking.

An additional paramount focus of the present invention is to do the foregoing in a reliable, facile, and economical fashion whereby floor components do not have to be disassembled and reassembled and no substantial or material removal of floor covering is necessary. Typically, all of the squeaks in the floors of an average residence can be de-squeaked in accordance with the principles of the present invention in only a few hours and at a modest cost.

Figure 1:
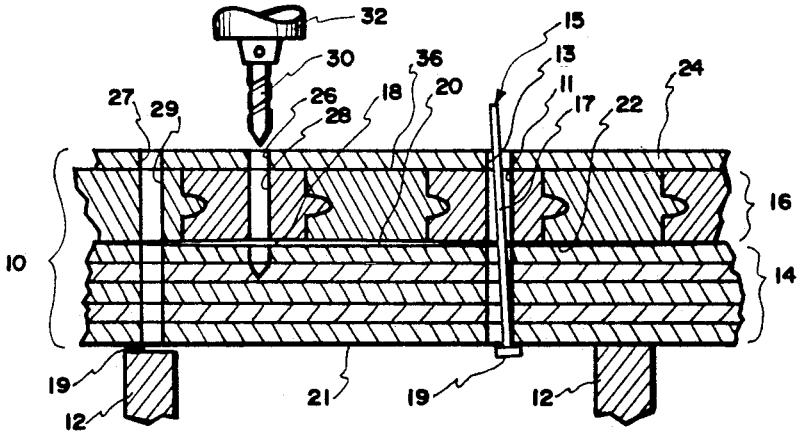
FIG. 1 is a fragmentary cross-sectional view illustrating some steps and equipment used in accordance with the principles of the present invention, by which a linoleum-covered floor may be drilled to de-squeak the floor.

More specifically, with reference to FIG. 1, a floor 10 is illustrated as being supported upon horizontally directed floor joists 12, in a conventional and well-known manner. Floor 10 is illustrated as being a multi-layer subfloor 14 comprising plywood and a floor or top floor segment 16, illustrated as comprising tongue and groove boards assembled conventionally. While not the only cause of a squeaky floor problem, FIG. 1 illustrates the existence of a cavity 18 between the top surface 20 of the subfloor 14 and the bottom surface 22 of the tongue and groove layer 16. Thus, the gap 18 is disposed at an interface between the subfloor 14 and the floor 16. The existence of the gap 18 is intended to illustrate broadly a condition which allows floor components to move one in respect to another to precipitate a squeaking noise as one walks across the floor 10. FIG. 1 also illustrates the existence of a gap 19 between the bottom surface 21 of the subfloor 14 and the top of the left floor joist 12.

Floor 10 also comprises a top floor covering 24 which may comprise any solid floor covering such as linoleum, tile, vinyl, or the like.

In some circumstances, the total depth of floor 10 will be known to the homeowner or someone available to the home owner for information, such as the contractor who originally constructed the home. In other instances, there may be locations where the total depth of floor 10 can be visually observed and measured for purposes of determining drilling depth during the de-squeaking process. In still other circumstances, the vertical depth of the floor 10 will be unknown. In such instances, it is presently preferred that a test hole be drilled through the floor 10 for the purpose of determining depth. Such a drill hole is illustrated at bore 11 in FIG. 1, the drilling of bore hole 11 preferably being accomplished after careful removal of a small disc in the floor covering 24 to create access hole 13. It is preferred that the diameter of the hole 13 and of the bore 11 be very small and that the location thereof be at a site of the floor 10 where squeaking does not exist.

To determine floor depth, it is presently preferred that a suitable hole depth locator or probe, generally designated 15, be used. Probe 15 comprises a very small diameter stem 17 and a disc 19 integrally disposed with the stem 17 at the distal end thereof. The stem 17 may be wire-like in its configuration and the diameter disc 19 must be less than the diameter of the bore 11 by inserting the probe 15 through the hole 13 and bore 11 to a location such that the disc 19 is disposed below the bottom surface 21 of the subfloor 14 is undertaken preparatory to depth determination. Thereafter, the probe 15 is placed at a slight angle in respect to the vertical and manually lifted until the disc 19 is contiguous with the surface 21. The user marks the stem 17 exposed above the floor covering 24 in such a way that, upon retrieval of the probe 15 from the bore 11, leaves the user in a position where he or she can measure the distance between the finger gripping site at the proximal end of the probe 15, obtained in the manner described above, and the disc 19. Once the depth of floor 10 has been so determined, the depth of penetration during the de-squeaking process can be readily determined in the manner set forth hereinafter.

Figure 8:
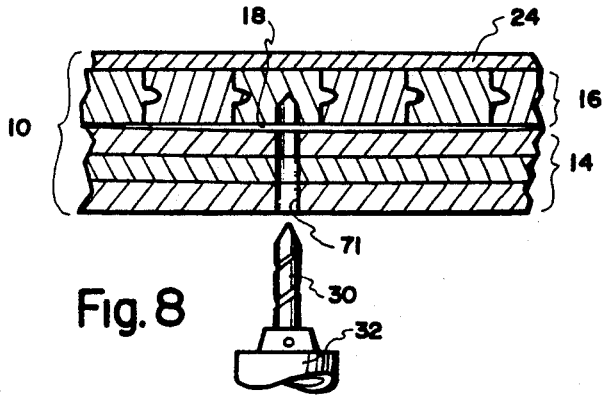
FIG. 8 is a fragmentary cross-section illustrating some steps and equipment used in accordance with the principles of the present inventor, by which a floor may be de-squeaked from a location below the floor.

After the depth of the floor 10 has been ascertained, it is necessary to create an opening 26 and/or 17 in the floor covering 24. This can be done in any suitable way. For example and without limitation, one or both holes 26 and 27 in the floor covering 24 may be drilled, cut, reamed, cored, or removed in any suitable way. The removal may be such that the portion of floor covering 24 removed from openings 26 and/or 27 is preserved as a plug for reinsertion into holes 26 and/or 27 after the cavity 18 and/or 19 is grouted, as explained herein in greater detail. The creation of the holes 26 and 27 presume that cavity 18 and gap 19 are reached from the top, rather than from the bottom, as illustrated in FIG. 8.

In order to complete the requirement for access to the interface 18 from the top of the floor 10, it is necessary that an access passageway 28 be formed in the floor 16, in alignment with opening 26. Similarly, to reach gap 19 an access passageway 29 must be formed through both th e floor 16 and the subfloor 14. In order to minimize any visual degradation to the floor covering 24 and to facilitate improved injection of flowable glue or the like, it is preferred that the openings 26, 27, 28 and 29 be small diameter. Experience to data indicates that access passageways on the order of 50/1000 of one inch may be used in practicing the present invention. Of course, if desired, larger access openings may be implemented. However, the larger the access opening the greater the risk that damage to the floor covering 24 may be caused to the extent that it will visually impair the appearance of the floor covering after the de-squeaking procedures have been completed.

One currently preferred mode of creating the excess passageways comprising openings 26 and 28 and 27 and 29 is to use a small bore bit 30 in conjunction with a convention drill 32. The drill 32 may be either hand-held or mounted in some type of a suitable drill press to insure correct alignment and reciprocation.

The initial step in determining the floor location for the access passageway comprising openings 26 and 28 or 27 and 29 is to simply walk upon the floor and to identify those areas where squeaks are generated as one traverses the floor. As many access passageways comprising openings 26 and 28 and/or 27 and 29 as necessary may be drilled in any floor area sufficient to make the floor in that area monolithic, as explained hereinafter, so as to remove the squeak. The spacings between access passageways is not critical and may be as close or as distant as is necessary to eliminate the squeaking noise.

It is to be apreciated from an analysis of FIG. 1 that in effect, the access passageway comprising openings 26 and 28 essentially comprises a blind bore, the internal depth of which accommodates injection of glue or the like into interface 18. Similarly, the access passageway comprising openings 27 and 29 essentially comprises a blind bore, the internal depth of which is common within gap 19.

The depth of the bore 28 is selected by subtracting some predetermined distance from the depth of the floor 10 as determined by information, inspection or as a consequence of using probe 15 in bore 11 as explained above. For example, the operator may subtract one-half of one inch from the depth of floor 10 to establish the depth to which bore 28 is to be drilled. Preferably, blind bore 28 will extend somewhat into subfloor 14, as illustrated in FIG. 1. It is currently believed that the bottom of bore 28 must be at least on the order of one-quarter of one inch above the bottom surface 21 of the subfloor 14.

Figure 2A:
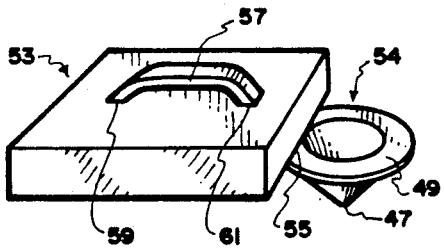
FIG. 2*a* is a perspective view of a funnel-shaped drill guide without spike retainers.
Figure 2:
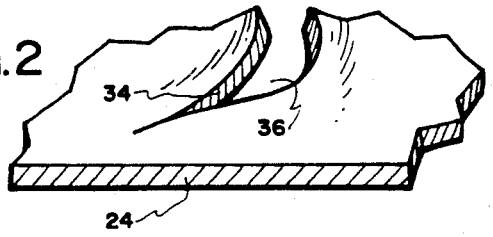
FIG. 2 is a fragmentary plan view of one manner by which a small area of linoleum or like floor covering may be slit and temporarily opened to floor drilling or other penetration in the course of practicing the present invention.
Figure 3:
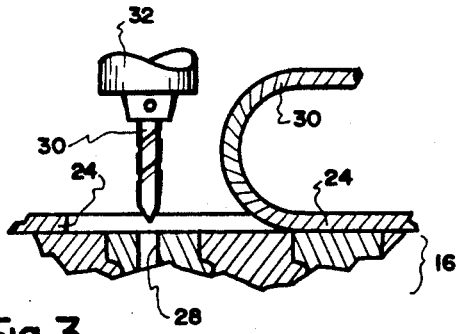
FIG. 3 is a fragmentary cross-section illustrating some steps and equipment used, in accordance with the principles of the present invention, by which a linoleum-covered floor may be drilled to de-squeak the floor.

With reference to FIGS. 2 and 3 it is to be appreciated that the creation of a blind bore access passageway to the interface at the top surface 20 of the subfloor 14 or to gap 19 can be achieved without drilling or coring of the floor covering 24. For example, in regard to FIG. 2, a surgical-like incision 34 may be made in the linoleum or like floor covering 24, using a sharp, thin blade. The lips of the floor covering 24 at the incision 34 may be manually spread so as to become separated from the top surface 36 of the floor 16. This drill bit 30 may then be inserted through the incision 34, in its rolled-backed or open state, to create the bore 28 and/or the bore 29 in the floor 16, essentially as illustrated in FIG. 1.

In a similar fashion, with reference to FIG. 3, a flap 30 may be cut from the remainder of the floor covering at 24 using a sharp knife or the like and pealed, back in the manner illustrated, to expose the top surface 36 of the floor 16 for drilling purposes using bit 30 and conventional drill 32. While illustrated as being a large flap in FIG. 3, the size of the flap is immaterial so long as the floor 16 is adequately exposed for drilling or the like. Advancement of the drill 32 with rotating drill bit 30 in a downward direction readily removes material from its path at floor 16 to create the bore 28.

For purposes of explaining one way the present invention may be used to eliminate a floor squeak below a carpeted area of the floor at gap 18, reference is made to FIG. 4. Specifically, the pile 50 of the carpet 52 is parted manually and a metal funnel device, generally designated 54, is placed into the parted area, spout down, to hold the pile away from the area where an access passageway to interface 18 is to be formed. Note that carpet 52 comprises a fabric backing 56 tautly superimposed over a layer of carpet pad 58. The lower annular tip 47 of the funnel device is preferably relatively sharp and is forced manually between threads of the carpet backing 56 and through the foam pad 58 until the tip 47 is essentially contiguous within the top 36 of the floor 16.

It is presently preferred that the angle formed by the cone-shaped portion of the funnel device be on the order of 45° in respect to both horizontal and the vertical. This creates a relatively shallow funnel-shaped mechanism, while at the same time allowing the user thereof to visually observe the pip 47 as it is advanced through the threads of the carpet and the foam pad as explained above.

The drill 32 with its bit 30 are aligned with the spout opening 60 of the funnel device at tip 47 and displaced in a downward direction substantially perpendicular to the plane of the floor 10'. The rotating bit 30 drills hole 64 in the floor layer 16, the bore 64 being illustrated as terminating slightly below the interface 18. Upon removal of the drill bit 30, the hole 64 essentially comprises a blind bore access passageway along which flowable filler material, such as glue, is injected into the interface 18 as hereinafter more fully explained. The funnel device 54 is left in the position illustrated in FIG. 4 through the glue injecting step, as explained hereinafter.

Figure 5:
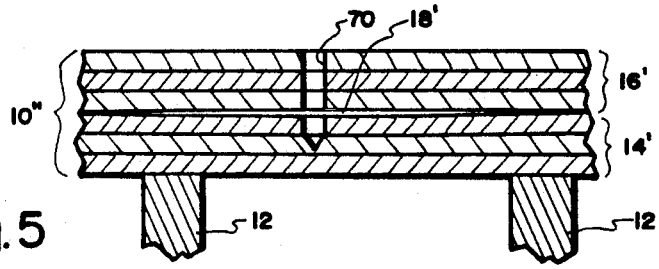
FIG. 5 is a fragmentary cross-section illustrating some steps and equipment used, in accordance with the principles of the present invention, by which a floor having no covering may be de-squeaked.

With reference to FIG. 5, the manner in which an access passageway is created for practicing the present invention with new construction prior to placement of a floor covering over the floor 10'' or where floor covering has been removed from floor 10'' is illustrated. Specifically, the floor 10 is illustrated as comprising a multiple layer plywood floor 16' and a multiple layer plywood subfloor 14' having an interface 18' disposed between the floor 16' and the subfloor 14'. An access passageway 70 is illustrated as having been drilled or otherwise created from the top down to a location slightly beyond where the access opening 70 intersects the interface 18'. The access opening 70 is used, as hereinafter explained, for the injection of glue or other suitable flowable filler material into the interface 18'.

The present invention also recognizes the desirability, which may exist under some circumstances, of accessing to the subfloor interface 18 of the floor 10 from the underside of the floor using the drill 32 and drill bit 30, or in any other fashion, to create upwardly directed access passageway. See access passageway 71 in FIG. 8.

Figure 9:
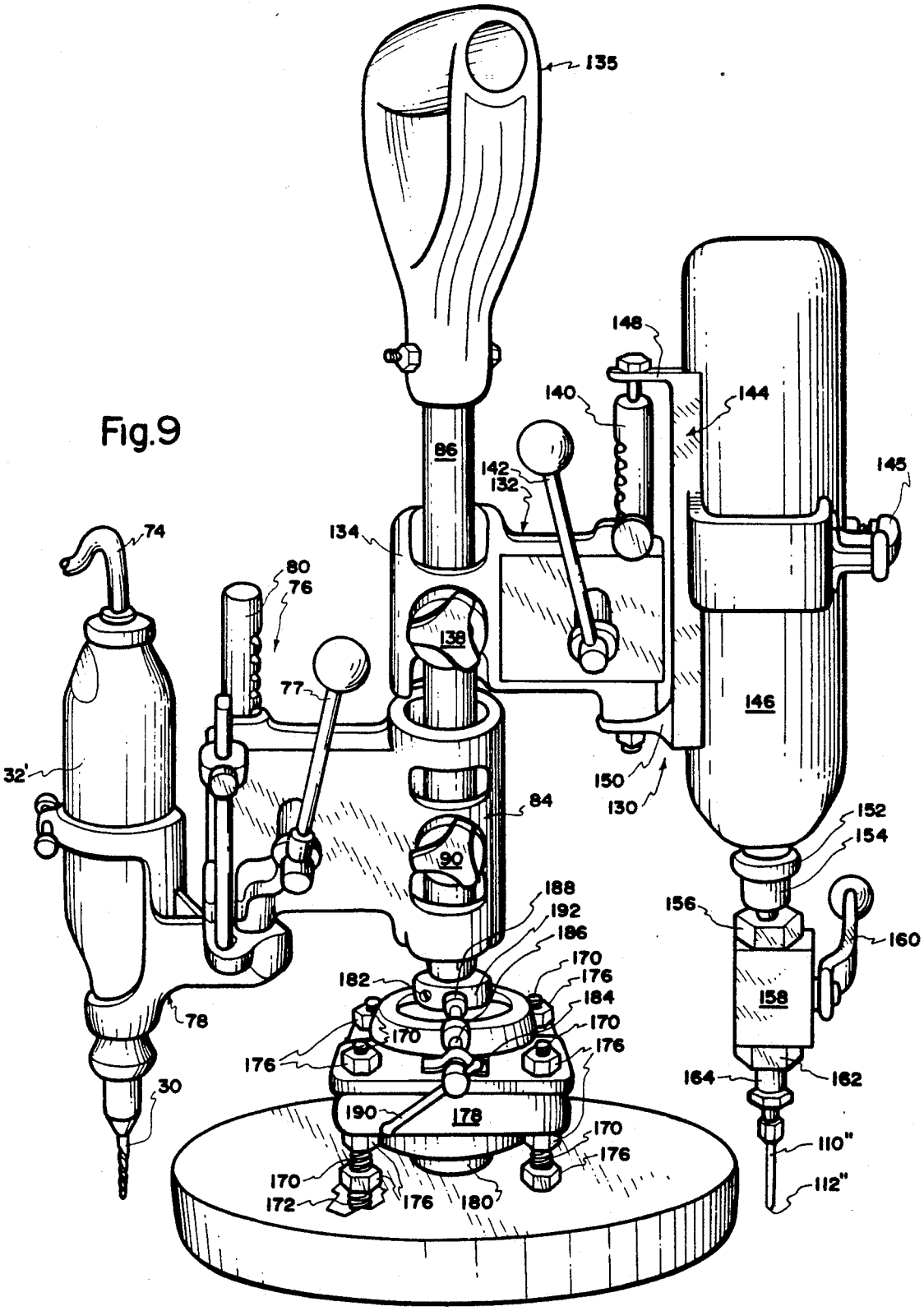
FIG. 9 is a perspective of equipment which may be used to drill and to inject filler glue to de-squeak a floor.

With reference to FIG. 9, it is to be appreciated that a drill 32', electrically serviced by cord 74, can be mounted to a drill press, generally designated 76, so that rotation of the drill press handle counterclockwise as illustrated in FIG. 9 will lower the drill 32' and bit 30 in a vertical orientation to create an access passageway of the type and as described above. The drill 32' is illustrated as being non-rotatably supported, in the shown position in FIG. 9, by a conventional bracket, generally designated 78, in a well known fashion. Bracket 78 is connected to the rack shaft 80 of the drill press 76 at the lower end thereof so that the drill 32', the drill bit 30, and the bracket 78 move up and down as the rack shaft 80 conventionally moves up and down responsive to manual manipulation of the handle 77.

Shaft 80 is reciprocally carried in a conventional housing, generally designated 84, one side of which surrounds a central mounting shaft 86 and is non-rotatably secured thereto by a conventional set screw manually set by handle 90. Thus, by rotation of bracket 76 around the shaft 86 after loosing of handle 90, the drill 32' and bit 30 can be rotated in a horizontal plane to a site where an access opening is to be created and, following creation of the access passageway, rotated to a remote position.

Figure 6:
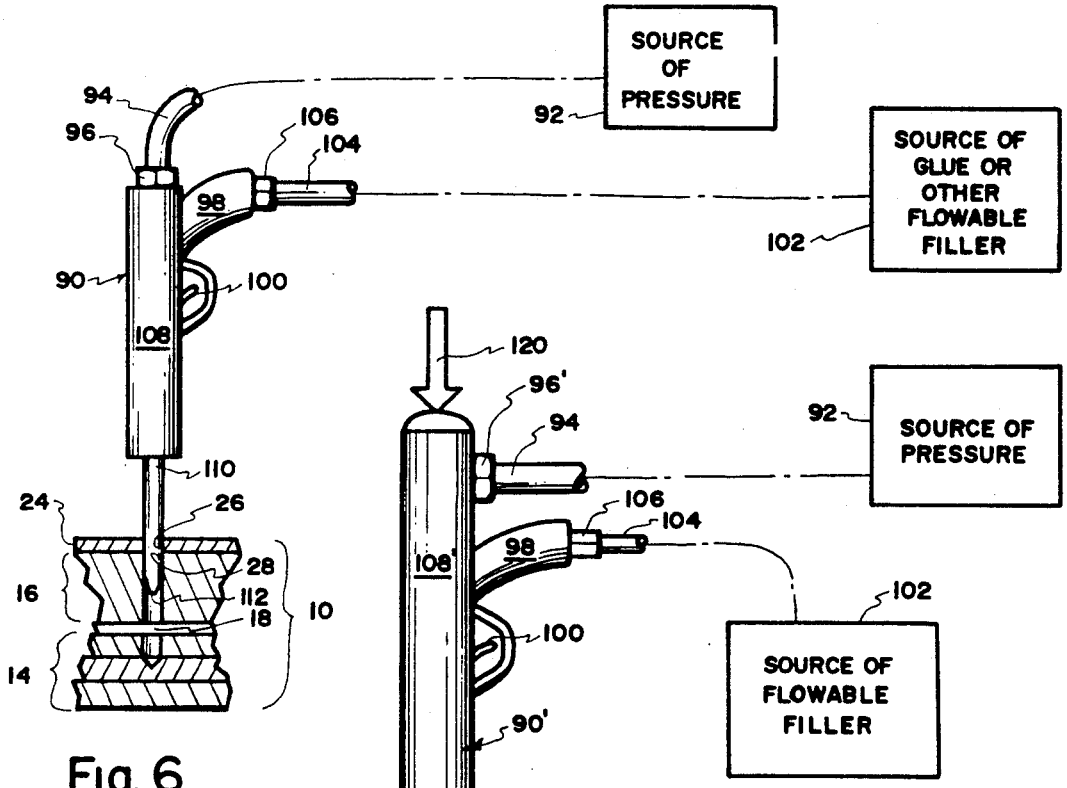
FIG. 6 is an elevational view, with parts broken away for clarity, of steps and equipment for practicing the present invention to inject a filler glue to de-squeak a floor.

With specific reference to FIG. 6, there is illustrated a fragmentary segment of previously described floor 10, possessed of an access opening comprising bores 26 and 28. The diametral size of the composite access passageway comprising bores 26 and 28, as mentioned above, is preferably only a few thousandths. For example, 50/1000 of one inch is typically acceptable.

FIG. 6 illustrates an injection gun, generally designated 90, of a conventional nature which is actuated by suitable source of pressure 92 delivered conventionally through the hollow interior of a conduit 94. Conduit 94 is connected to the gun 90 at a fitting in 96 in a conventional fashion and actuates an internal piston to reciprocate the same in a well known manner. Since, in many installations, pressures of 700 pounds per square inch are desirable to force the glue from the gun 90, typically the source of air or gas pressure 92 is a high pressure source.

The injection gun 90 comprises a manual handle 98 and a trigger 100. A predetermined charge of flowable glue or other suitable flowable filler from source 102 is delivered in a well-known and conventional fashion via hose or conduct 104 to the interior of the gun 90. Fitting 106 connects the conduit 104 to the gun 90 at the handle 98. Typically the handle 98 comprises an internal valve which in a conventional manner selectively opens and closes responsive to actuation of the trigger 100 to recharge a chamber of the gun 90 adjacent the reciprocating piston thereof in preparation for the injection of a predetermined quantity of flowable glue or other filler material.

The injection gun 90 is illustrated as comprising a barrel 108 which is interiorly hollow, the hollow interior thereof communicating with the hollow interior of a male projection 110 extending from the distal end of the gun 90. The length of the male projection 110 is sufficient to accommodate its placement well within any access passageway of the type described above for purposes of injecting the glue or other flowable filler material into the interface 18. The hollow interior of the male projection 110 communicates the glue or other flowable filler material to an effluent port 112 of the male projection 110 and from thence to the interface 18.

The diameter of the male projection 110 is preferably a few thousandths of one inch larger than the diameter of the bores 26 and 28 so that insertion of the male projection 110 into the access passageway comprising bores 26 and 28 creates a force-fit relationship which seals the access passageway adjacent the male projection 110 and prevents backflow of glue or the like between the male projection 110 and the bore 28. As a consequence, when the operator squeezes the trigger 110, the piston internal of the gun 90, responsive to the pressure applied to the proximal side thereof from source 92 is advanced distally placing the glue under pressure and extruding the glue from the distal effluent opening 112 along the internal distal portion of the bore 28 and thence along the interface 18. Thus, the male projection 110 takes on the physical appearance of a hypodermic needle. One suitable glue is Elmer's glue, either diluted or nondiluted.

This forces the glue not only along the interface 18, but into all contiguous flooring joints, up and down loose nail holes, into seams and around exposed portions of nails and other floor fasteners as well as into contiguous spaces between the fibers of the wood comprising the top of the subfloor 14 and the lower portion of the floor 16.

Thereafter, the male projection 110 is vertically pulled from the access passageway comprising bores 26 and 28. Any residual glue is wiped away from the floor covering 24 and the injected glue within the floor is allowed to dry, solidify, and cure. The result is an essentially monolithic structure at the injection area wherein no floor component is free to move relative to any other floor component in that region.

By placing the access passageways in a closely spaced pattern, a large area wherein a floor previously squeaky in its nature responsive to persons walking across the floor can be made to be monolithic as described above. The area can be progressively enlarged in which injections take place until, by trial and error, the entire floor area is de-squeaked in the manner explained above. Any floor covering plugs, (areas of the floor covering removed to create openings 26 and/or 27) or areas where flaps have been cut from the floor covering can be replaced and adhesively secured in their original positions. Chemicals are available by which any resulting seam in the vinyl or linoleum floor covering can be visually negated.

Figure 4:
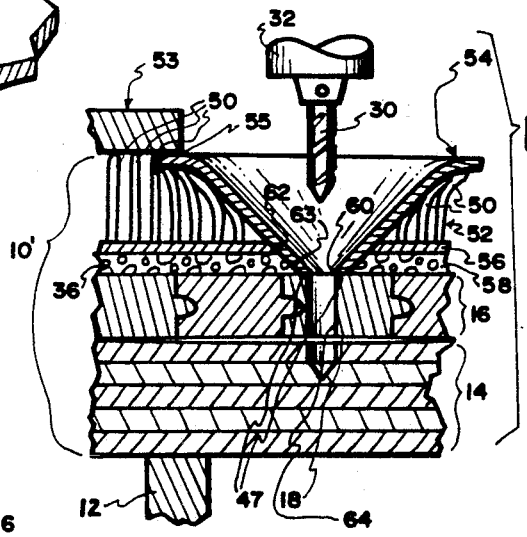
FIG. 4 is a fragmentary cross-section illustrating some steps and equipment used in accordance with the principles of the present invention, by which a carpet-covered floor may be de-squeaked without removal of the carpet, using a funnel-shaped drill guide having spike retainers.
Figure 4A:
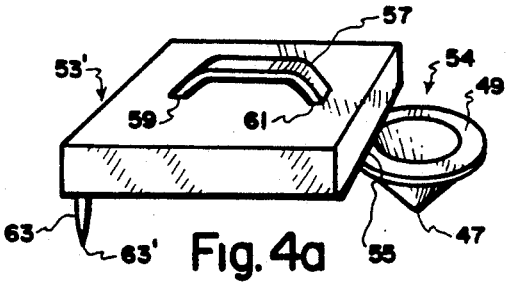
FIG. 4*a* is a perspective of the funnel-shaped drill guide of FIG. 4.

In the case of a carpet floor covering, as illustrated in FIG. 4, the funnel mechanism 54 may be attached to a stabilizing block which is either without or with stabilizing spikes. A preferred non-spike block is illustrated in FIG. 2*a*, while a presently preferred spiked version is shown in FIG. 4*a*. With the funnel guide 54 positioned as illustrated in FIG. 4, the male projection 110 is extended through the funnel opening 60 and press-fit internally within the bore 64 prior to the above-described injection of glue or like flowable filler material.

Figure 7:
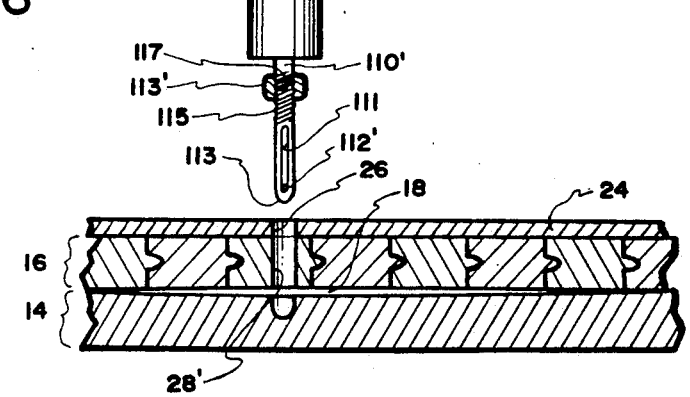
FIG. 7 is an elevational view, with parts broken away for clarity, of steps and equipment for practicing the present invention to impact penetrate a floor to the subfloor without drilling and to thereafter inject a filler glue to de-squeak a floor.

Reference is now made to FIG. 7, which illustrates an impact gun 90' similar in many respects to the gun 90. Corresponding numbers have been used where parts of gun 90' are identical to the above-described parts of gun 90. Only those parts which differ will be described. Fitting 96' connects the conduit 94 to the side rather than the end of the barrel 108'. The barrel 108' is larger and capable of absorbing impact forces without damage, diagrammatically illustrated by arrow 120 in FIG. 7. Impact forces, diagrammatically illustrated at 120, may be from any suitable source, such as those created by conventional impact tools, with the intent that the male projection 110' is driven through the floor 16 by the impact 120 along a corridor illustrated at 28' to dispose a hollow channel 111 side effluent port 112' at interface 18. The impact delivery of the male projection 110' drives rounded solid distal tip 113 of the male projection 110' through layer 16 of the floor into the subfloor 14 to create bore 28' and expose the channel 111 at interface 18. An adjustable annular seal 113' creates a force-fit sealed relationship between the exterior of the male projection 110' and the bore 28'. In this position, the above-described glue injection phase is initiated and completed. Male projection 110' comprises central threads 115. The adjustable annular seal 113' is correspondingly threaded at its interior bore at 117. By adjusting the location of the annular seal 113'in its threaded engagement upon threads 115 of male projection 110', the depth to which the distal tip 113 is permitted to penetrate is controlled and the location of the seal formed between the annular seal 113 and the bore 28' is determined.

With reference to FIG. 9, the glue injection phase may be practiced using the apparatus generally designated 130. Specifically, a conventional bracket 132, at collar 134, surrounds support shaft 86 at a location above the housing 84. Rotation of the surrounding collar 134 in respect to shaft 86 is conventionally prevented by a set screw 136, when tightened into position by a manual handle 138. The bracket 132 comprises a drill press mechanism, which comprises a conventional rack shaft 140, reciprocally carried within the housing 132 and a drill press manual handle 142, selective rotation of which in a well known manner reciprocates the rack shaft 140. A channel-shaped bracket 144 is releasibly clamped at 145 in a conventional manner to the exterior surface of a canister 146. The bracket 144 is connected by a pair of arms 148 and 150 to the reciprocable rack shaft 140. Thus, conventional selective rotation of the drill press handle 142 will vertically displace the rack shaft 140, the bracket 144, and the cylindrical canister 146. When lowered, in vertical alignment with a site where an access passageway of the type described above has been created, the male projection 110'' will be press-fit into the access passageway to create a seal therewith, following which glue contained within the canister 146 under high gas pressure is selectively delivered via effluent distal port 112'' to the desired floor interface.

The canister 146 is preferably loaded, using conventional methods, with a predetermined amount of flowable glue or like flowable filler material and a quantity of gas, such as nitrogen, under high pressure, for example, 700 psi. The canister 146 is typically formed of steel and comprises a hollow outlet at 152 by which flowable glue or the like under pressure is delivered through hollow fittings 154, and 156, to a valve 158. Valve 158 is conventional and comprises a manual handle 160, selective rotation of which opens and closes the interior of the valve 158 allowing and stopping, respectively, the flow of glue through hollow fittings 162 and 164 to the hollow interior of the male projection 110'' and out the egress opening 112'' at the distal end of the male projection 110 double prime.

In respect to FIG. 9, it should be observed that, as illustrated, four threaded shafts 170 support the shaft 86 and everything carried by the shaft 86. Each threaded shaft 170 is anchored in a blind threaded bore 172 in a base plate 174. By use of nuts 176, the support 178 for the shaft 86 is leveled, which causes the shaft 86 to extend in exactly a vertical direction. The support 178 rotationally receives a spindle mechanism 180 non-rotatably secured to the lower end of the shaft 86 by said screw 182.

A collar 184 comprising a threaded throughbore is anchored, for example by welding, to the support 178 and threaded receives a shaft 186, which at one end comprises an abutment 188 and at the other a handle 190 by which the shaft 186 is rotated. By advancing the threaded shaft 186, the abutment 188 is caused to forcibly engage an adjacent collar 192 of the spindle 180, thereby preventing rotation of the spindle, the shaft 86, the drill 32', and the injection canister 146.

By loosening the threaded shaft 186 so that the abutment 188 is removed from the collar 192, allowing rotation of the spindle 180, the shaft 86, the drill 32' and the glue injector canister 146. As mentioned above, preferably the drill bit 30 and the male projection 110'' travel along a common radius so that each in succession can be rotated into a desired position for drilling and injection, respectively, merely by rotating.

Reference is made to FIG. 2*a*. The funnel device 54, previously described in conjunction with the FIG. 2, may be attached along a top radial flange 49, at weldment 55, to a heavy metal stabilizing block 53 which is without spikes. It is presently preferred that the stabilizing block 53 be rectangle in configuration and that it weighs approximately 15 pounds. Accordingly, when the tip of the funnel 54 is positioned as illustrated in FIG. 4, the funnel 54 will be stable and resist significantly any inadvertent displacement which might otherwise tear or damage the floor covering 24 at incision 34. The anchor block 53 preferably comprises a manual handle 57 of suitable metal secured at weldment sites 59 and 61 to the top of the block 53. The bottom surface of the anchor block 53 is illustrated as being flat and uninterrupted. When the funnel mechanism 54 is to be used in conjunction with a spiked stabilizing block, it is presently preferred that the funnel mechanism 54 be secured to anchor block 53' (FIG. 4*a*), at weldment site 55. Weldment 55 is imposed between flange 49 of the funnel mechanism 54 and the underside of the stabilizing block 53'. Block 53' is identical to abutment block 53 except the undersurface of the block 53' is equipped with at least two pointed thin gripping fingers or spikes 63 (located adjacent each of the two corners of the block 53' remote from weldment 55). Each spike 63 is preferably comprised of a sharp tip 63' and comprises a vertical length extending below the bottom surface of the block 53' a distance substantially equal to the vertical distance spanned by of the funnel mechanism 53. Thus, when the block 53' and funnel mechanism 54 are integral and used concurrently, the funnel being placed into the position illustrated in FIG. 4, the tip 63' of each spike 63 will engage and be slightly depressed into the top surface of the floor 16 to retain the position of the block 53' and the funnel 54 and prevent inverted displacement.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of de-squeaking a floor comprising the steps of:

drilling a small access opening from a position below the floor through a surface of the floor to a location adjacent to an interface above a subfloor segment of the floor;

causing a removable male projection to be positioned in the access opening so as to seal the access opening at a site thereof against flow between the seal site and said surface of the floor;

thereafter injecting a flowable filler substance under pressure from the male projection along the access opening between the seal site and the interface and thence along the interface;

removing the male projection from the access opening;

allowing the injected filler substance to cure.

2. A method of de-squeaking a floor comprising the steps of:

impact driving an implement through the floor from a surface of the floor to a location adjacent to an interface above a subfloor segment of the floor;

causing a removable male projection to be positioned in the access opening so as to seal the access opening at a site thereof against flow between the seal site and said surface of the floor;

thereafter injecting a flowable filler substance under pressure from the male projection along the access opening between the seal site and the interface and thence along the interface;

removing the male projection from the access opening;

allowing the injected filler substance to cure.

3. A method according to claim 2 wherein the implement impact driving step comprises forcing the male projection through a solid portion of the floor to the interface.

4. A method of de-squeaking a floor comprising the steps of:

creating a small access opening from a surface of the floor to a location adjacent to an interface above a subfloor segment of the floor, this creating step including penetration of a backing layer of carpet disposed at the top of the floor;

causing a removable male projection to be positioned in the access opening so as to seal the access opening at a site thereof against flow between the seal site and said surface of the floor;

thereafter injecting a flowable filler substance under pressure from the male projection along the access opening between the seal site and the interface and thence along the interface;

removing the male projection from the access opening;

allowing the injected filler substance to cure.

5. A method according to claim 4 wherein the penetration step comprises using a guide above the floor to control the location where penetration occurs.

6. A method of de-squeaking a floor comprising the steps of:

creating a small access opening from a surface of the floor to a location adjacent to an interface above a subfloor segment of the floor, this creating step comprising passing through a floor covering disposed at the top of the floor;

causing a removable male projection to be positioned in the access opening so as to seal the access opening at a site thereof against flow between the seal site and said surface of the floor;

thereafter injecting a flowable filler substance under pressure from the male projection along the access opening between the seal site and the interface and thence along the interface;

removing the male projection from the access opening;

allowing the injected filler substance to cure.

7. A method according to claim 6 wherein the passing through step comprises passing through a floor covering comprising linoleum.

8. A method of de-squeaking a floor comprising the steps of:

creating a small access opening from a surface of the floor to a location adjacent to an interface above a subfloor segment of the floor, this creating step comprising removing a portion of a floor covering from a location of the floor where the small access opening is to be formed;

causing a removable male projection to be positioned in the access opening so as to seal the access opening at a site thereof against flow between the seal site and said surface of the floor;

thereafter injecting a flowable filler substance under pressure from the male projection along the access opening between the seal site and the interface and thence along the interface;

removing the male projection from the access opening;

allowing the injected filler substance to cure.

9. A method according to claim 8 wherein the removing step comprises cutting the floor covering.

10. A method according to claim 8 wherein the removing step comprises drilling the floor covering.

11. A method according to claim 8 wherein the removing step comprises peeling the floor covering.

12. A method of de-squeaking a floor comprising the steps of:

creating a small access opening from a surface of the floor to a location adjacent to an interface above a subfloor segment of the floor;

causing a removable male projection to be positioned in the access opening so as to seal the access opening at a site thereof against flow between the seal site and said surface of the floor, this causing step comprising manually manipulating the male projection into position;

thereafter injecting a flowable filler substance under pressure from the male projection along the access opening between the seal site and the interface and thence along the interface;

removing the male projection from the access opening;

allowing the injected filler substance to cure.

13. A method of de-squeaking a floor comprising the steps of:

creating a small access opening from a surface of the floor to a location adjacent to an interface above a subfloor segment of the floor;

causing a removable male projection to be positioned in the access opening so as to seal the access opening at a site thereof against flow between the seal site and said surface of the floor, this causing step comprising mechanically manipulating the male projection into position;

thereafter injecting a flowable filler substance under pressure from the male projection along the access opening between the seal site and the interface and thence along the interface;

removing the male projection from the access opening;

allowing the injected filler substance to cure.

14. A method of de-squeaking a floor comprising the steps of:

creating a small access opening from a surface of the floor to a location adjacent to an interface above a subfloor segment of the floor;

causing a removable male projection to be positioned in the access opening so as to seal the access opening at a site thereof against flow between the seal site and said surface of the floor, this causing step comprising sizing the male projection to be small gauge so as to be slightly transversely larger than the access opening and force-fitting the small gauge male projection into the access opening a desired distance to create the seal;

thereafter injecting a flowable filler substance under pressure from the male projection along the access opening between the seal site and the interface and thence along the interface;

removing the male projection from the access opening;

allowing the injected filler substance to cure.

15. A method of de-squeaking a floor comprising the steps of:

creating a small access opening from a surface of the floor to a location adjacent to an interface above a subfloor segment of the floor;

causing a removable male projection to be positioned in the access opening so as to seal the access opening at a site thereof against flow between the seal site and said surface of the floor, this causing step comprising sizing the male projection to be small gauge and inserting the small gauge male projection between threads of a backing of a carpet of the floor into the access opening;

thereafter injecting a flowable filler substance under pressure from the male projection along the access opening between the seal site and the interface and thence along the interface;

removing the male projection from the access opening;

allowing the injected filler substance to cure.

16. A method of de-squeaking a floor comprising the steps of:

creating a small access opening from a surface of the floor to a location adjacent to an interface above a subfloor segment of the floor;

causing a removable male projection to be positioned in the access opening so as to seal the access opening at a site thereof against flow between the seal site and said surface of the floor;

thereafter injecting a flowable filler substance under pressure from the male projection along the access opening between the seal site and the interface and thence along the interface, this injecting step comprising applying pressure to a charge of the filler material within an injection device to cause the filler material to flow into the interface responsive to said applied pressure;

removing the male projection from the access opening;

allowing the injected filler substance to cure.

17. A method of de-squeaking a floor comprising the steps of:

creating a small access opening from a surface of the floor to a location adjacent to an interface above a subfloor segment of the floor;

causing a removable male projection to be positioned in the access opening so as to seal the access opening at a site thereof against flow between the seal site and said surface of the floor;

thereafter injecting a flowable filler substance under pressure from the male projection along the access opening between the seal site and the interface and thence along the interface, this injecting step comprising displacing the filler material comprising glue from a gun under pressure into the interface so as to impregnate fibers of wood comprising the floor adjacent to the interface whereby curing of the glue creates a substantially monolithic structure at, immediately above and immediately below the interface so that relative movement of floor components at a location where the glue has been injected is substantially prohibited;

removing the male projection from the access opening;

allowing the injected filler substance to cure.

18. A method of de-squeaking a floor comprising the steps of:

creating a small access opening from a surface of the floor to a location adjacent to an interface above a subfloor segment of the floor;

causing a removable male projection to be positioned in the access opening so as to seal the access opening at a site thereof against flow between the seal site and said surface of the floor;

thereafter injecting a flowable filler substance under pressure from the male projection along the access opening between the seal site and the interface and thence along the interface;

removing the male projection from the access opening;

allowing the injected filler substance to cure;

placing floor covering over the access opening after the removing step.

* * * * *